US009048568B2

(12) United States Patent
Chien

(10) Patent No.: US 9,048,568 B2
(45) Date of Patent: Jun. 2, 2015

(54) EASY-PULL MALE NETWORK CONNECTOR

(71) Applicant: NINGBO EXCELLENCE COMMUNICATED CONNECTOR CO., LTD., Zhejiang (CN)

(72) Inventor: Chien-Hsun Chien, Taoyuan Hsien (TW)

(73) Assignee: NINGBO EXCELLENCE COMMUNICATED CONNECTOR CO., LTD., Zhejiang (CN)

( * ) Notice: Subject to any disclaimer, the term of this patent is extended or adjusted under 35 U.S.C. 154(b) by 100 days.

(21) Appl. No.: 14/029,398

(22) Filed: Sep. 17, 2013

(65) Prior Publication Data

US 2014/0377977 A1 Dec. 25, 2014

(30) Foreign Application Priority Data

Jun. 20, 2013 (CN) ..... 2013 2 0358055 U

(51) Int. Cl.

| | |
|---|---|
| ***H01R 13/627*** | (2006.01) |
| ***H01R 13/62*** | (2006.01) |
| ***H01R 13/633*** | (2006.01) |
| *H01R 24/64* | (2011.01) |

(52) U.S. Cl.

CPC ..... *H01R 13/62* (2013.01); *H01R 13/633* (2013.01); *H01R 24/64* (2013.01)

(58) Field of Classification Search

USPC ..... 439/344, 352

See application file for complete search history.

(56) References Cited

U.S. PATENT DOCUMENTS

| | | | | |
|---|---|---|---|---|
| 4,548,455 | A * | 10/1985 | Ezure | 439/152 |
| 6,371,787 | B1 * | 4/2002 | Branch et al. | 439/352 |
| 6,585,537 | B1 * | 7/2003 | Lee | 439/358 |
| 6,776,646 | B2 * | 8/2004 | Lee | 439/357 |
| 6,863,556 | B2 * | 3/2005 | Viklund et al. | 439/354 |
| 7,037,129 | B2 * | 5/2006 | Lo et al. | 439/352 |
| 7,297,013 | B2 * | 11/2007 | Caveney et al. | 439/352 |
| 7,465,180 | B2 * | 12/2008 | Kusuda et al. | 439/352 |
| 7,517,241 | B2 * | 4/2009 | Gundlach et al. | 439/352 |
| 7,901,237 | B2 * | 3/2011 | Abe et al. | 439/354 |
| 7,959,455 | B1 * | 6/2011 | Armstrong et al. | 439/354 |
| 8,187,018 | B2 * | 5/2012 | Kosugi | 439/344 |
| 8,840,419 | B2 * | 9/2014 | Huang | 439/352 |

* cited by examiner

*Primary Examiner* — Neil Abrams

(74) *Attorney, Agent, or Firm* — Guice Patents PLLC

(57) ABSTRACT

An easy-pull network connector includes a male connector body providing a resilient clip lockable to a mating female network connector, a protective jacket surrounding the male connector body, a bracket located at one end of the male connector body remote from the resilient clip, a pivotable hook pivotally mounted at the bracket and hooked on the resilient clip and biasable to release or press the resilient clip when the protective jacket is moved forwards or backwards relative to the male connector body. Thus, when the user pulls the protective jacket backward to press the resilient clip, the easy-pull network connector is disengaged from the mating female network connector.

3 Claims, 3 Drawing Sheets

EASY-PULL MALE NETWORK CONNECTOR

BACKGROUND OF THE INVENTION

1. Field of the Invention

The present invention relates to electrical connector technology, and more particularly to an easy-pull male network connector that can be conveniently pulled out of the mating female network connector.

2. Description of the Related Art

A male network connector insertable into a mating female network connector for data transmission may be equipped with a safety structure made in the form of a resilient clip. A commercial male network connector is known comprising a male connector body electrically connected to one end of a cable, a protective jacket surrounding the male connector body around the cable, and a resilient clip located at one end of the male connector body. After insertion of the male network connector into an insertion hole of a mating female network connector, the resilient clip is forced into engagement with a retaining groove inside the insertion hole to lock the male network connector to the female network connector. When wishing to remove the male network connector from the female network connector, press down the resilient clip to disengage the resilient clip from the retaining groove and then pull the male network connector out of the insertion hole of the female network connector. However, if the female network connector is disposed in an area where the user's hand cannot access to the resilient clip of the male network connector conveniently, the user will be difficult to remove the male network connector from the female network connector.

SUMMARY OF THE INVENTION

The present invention has been accomplished under the circumstances in view. It is the main object of the present invention to provide an easy-pull male network connector, which eliminates the drawback of the aforesaid prior art design.

DETAILED DESCRIPTION OF THE INVENTION

Figure 1:
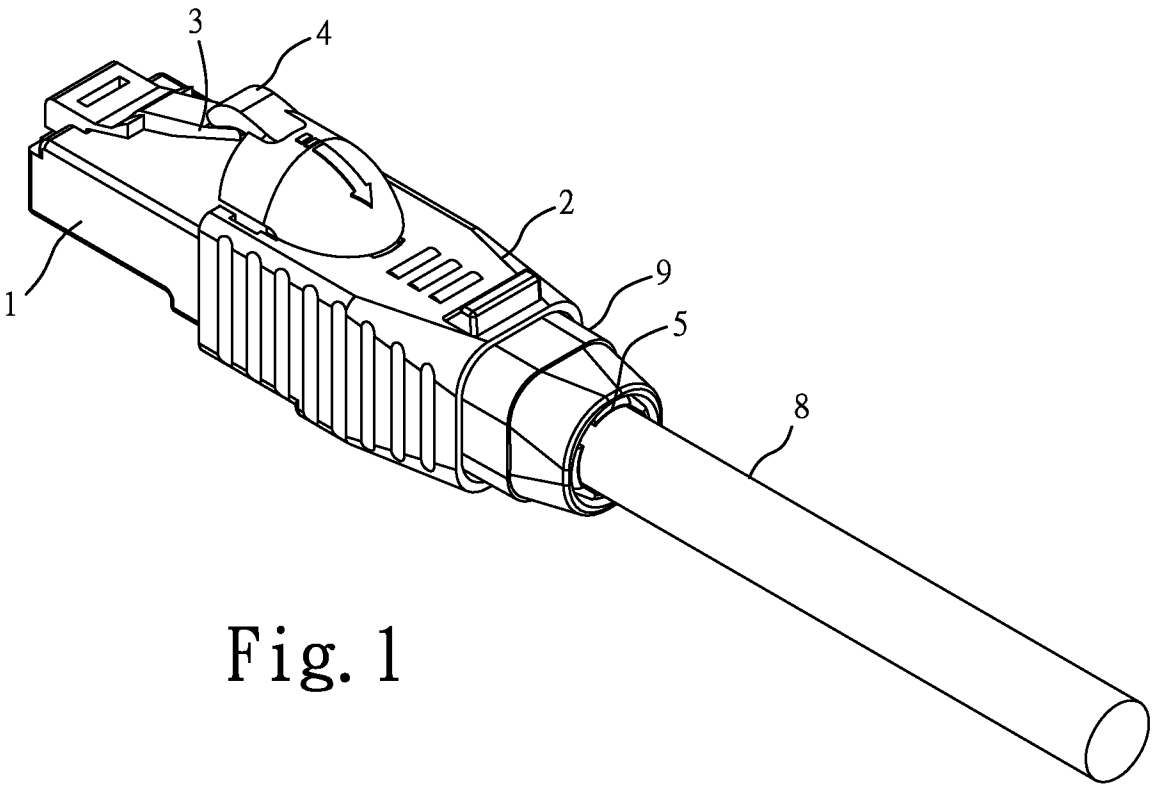
FIG. 1 is an oblique top elevational view of an easy-pull male network connector in accordance with the present invention.
Figure 2:
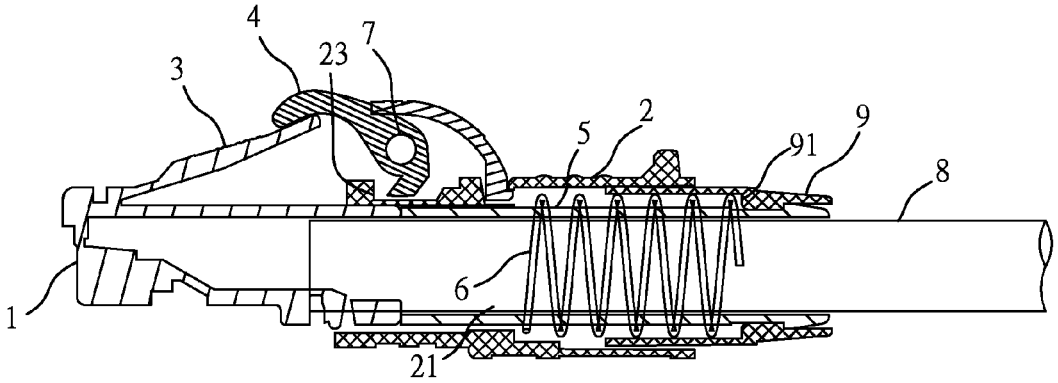
FIG. 2 is a longitudinal sectional view of the easy-pull male network connector in accordance with the present invention.
Figure 4:
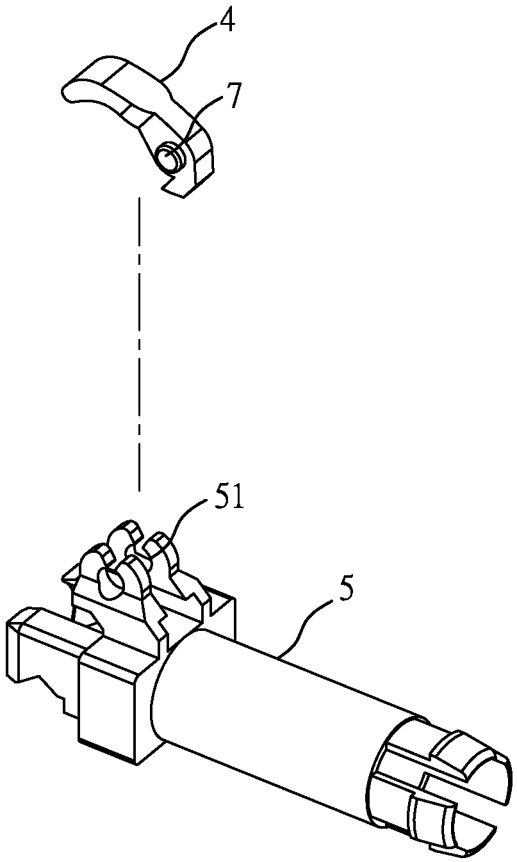
FIG. 4 is an exploded view, in an enlarged scale, of a part of the present invention, illustrating the relationship between the pivotable hook and the bracket.

Referring to FIGS. 1 and 2, an easy-pull network connector in accordance with the present invention is shown. The easy-pull network connector comprises a female connector body 1, and a protective jacket 2 movably mounted around the female connector body 1. The female connector body 1 is electrically connected to one end of a cable 8, comprising a resilient clip 3 located at a top side of one end thereof and a bracket 5 located at an opposite end thereof (see FIG. 2 and FIG. 4) and adapted to secure the protective jacket 2. Further, the cable 8 has its other end extending out of the protective jacket 2.

The main features of the present invention are outlined hereinafter:

The invention further comprises a pivotable hook 4 hooked on the resilient clip 3, a spring member 6 mounted around the bracket 5 within the protective jacket 2 and stopped at an internal first shoulder 21 of the protective jacket 2. Further, the pivotable hook 4 is pivotally connected to a pivot hole 51 of the bracket 5 by a pivot pin 7 (see FIG. 4).

Figure 3:
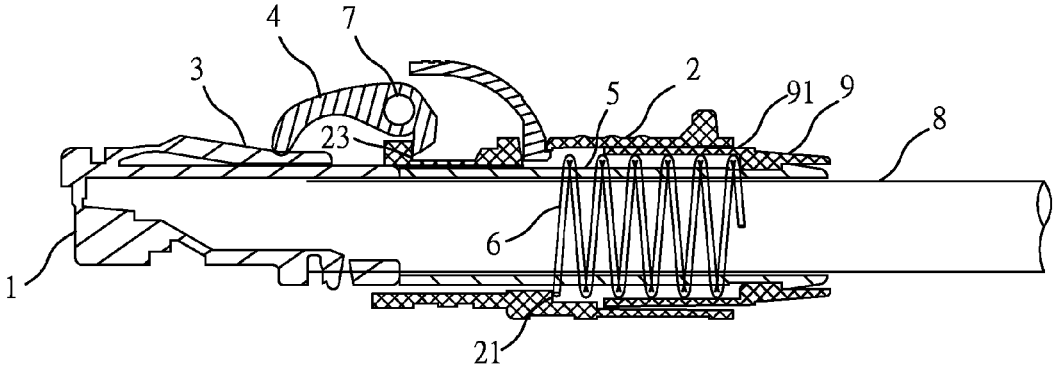
FIG. 3 is a schematic sectional operational view of the present invention, illustrating the protective jacket pulled backwards.

When going to remove the easy-pull male network connector from the mating female network connector, the user simply needs to pull the protective jacket 2 backwards (see FIG. 3). At this time, the first shoulder 21 of the protective jacket 2 will be moved backwards with the protective jacket 2 to compress the spring member 6, and an actuation portion 23 of the protective jacket 2 (see FIG. 3) will be simultaneously forced to bias the pivotable hook 4 relative to the bracket 5 in one direction to impart a downward pressure to the resilient clip 3 (see FIG. 3), thereby disengaging the resilient clip 3 from the female network connector and allowing removal of the easy-pull male network connector from the mating female network connector. Thus, the invention can be installed in a mating female network connector in a narrow or hidden place where the user's hand cannot access to the resilient clip of the male network connector conveniently.

The male network connector further comprises a tail cuff 9 mounted at one end of the bracket 5 remote from the pivotable hook 4. The tail cuff 9 defines therein a second shoulder 91 that is stopped against the other end of the spring member 6.

In conclusion, the invention provides an easy-pull network connector, which allows the user to bias the pivotable hook in releasing or pressing the resilient clip by means of moving the protective jacket forward and backward, and thus the user can remove the easy-pull network connector from the mating female network connector easily and rapidly simply by pulling the protective jacket backward to press the resilient clip.

What is claimed is:

1. An easy-pull male network connector, comprising a male connector body electrically connected to one end of a cable, a protective jacket surrounding said male connector body around said cable, a resilient clip located at one end of said male connector body and adapted for locking said male connector body to a mating female network connector after insertion of said male connector body into an insertion hole in said mating female network connector, and a bracket located at an opposite end of said male connector body and adapted to secure said protective jacket to said male connector body, wherein said protective jacket comprises a first shoulder located at an inner side thereof and an actuation portion located at an outer side thereof; the easy-pull male network connector further comprises a pivotable hook mounted at said bracket and hooked on said resilient clip, and a spring member mounted around said bracket within said protective jacket and stopped between said first shoulder of said protective jacket and a part of said bracket to impart a forward pressure to said protective jacket relative to said bracket such that when said protective jacket is moved backwards relative to said bracket and said male connector body, said spring member is compressed to preserve an elastic potential energy and said actuation portion of said protective jacket is force to bias said pivotable hook relative to said bracket in imparting a downward pressure to said resilient clip.

2. The easy-pull male network connector as claimed in claim 1, wherein said bracket comprises a pivot hole, and a pivot pin mounted in said pivot hole to pivotally connect one end of said pivotable hook to said bracket.

3. The easy-pull male network connector as claimed in claim 1, wherein said bracket comprises a tail cuff located at one end thereof remove from said pivotable hook, said tail cuff defining therein a second shoulder that is stopped against one end of said spring member opposite to said protective jacket.

* * * * *